US007437887B2

(12) United States Patent
Hinder et al.

(10) Patent No.: US 7,437,887 B2
(45) Date of Patent: Oct. 21, 2008

(54) RECIRCULATION COOLING SYSTEM

(75) Inventors: Henno Hinder, Bad Endbach (DE); Andreas Müller, Freudenberg (DE)

(73) Assignee: Rittal GmbH & Co. KG, Herborn (DE)

( * ) Notice: Subject to any disclaimer, the term of this patent is extended or adjusted under 35 U.S.C. 154(b) by 14 days.

(21) Appl. No.: 10/552,392

(22) PCT Filed: Feb. 5, 2004

(86) PCT No.: PCT/EP2004/001037

§ 371 (c)(1),
(2), (4) Date: Sep. 11, 2006

(87) PCT Pub. No.: WO2004/090430

PCT Pub. Date: Oct. 21, 2004

(65) Prior Publication Data

US 2007/0000280 A1 Jan. 4, 2007

(30) Foreign Application Priority Data

Apr. 7, 2003 (DE) ..... 103 16 045

(51) Int. Cl.
*F25B 1/00* (2006.01)

(52) U.S. Cl. ..... 62/498; 62/95; 62/171; 62/304

(58) Field of Classification Search ..... 62/95, 62/171, 201, 304, 498
See application file for complete search history.

(56) References Cited

U.S. PATENT DOCUMENTS

| | | | | |
|---|---|---|---|---|
| 4,776,180 | A | 10/1988 | Patton, Sr. et al. | |
| 5,839,295 | A | 11/1998 | Lehmann | |
| 6,182,453 | B1 * | 2/2001 | Forsberg | 62/125 |
| 2002/0166334 | A1 | 11/2002 | Houk et al. | |

FOREIGN PATENT DOCUMENTS

| | | | |
|---|---|---|---|
| DE | 44 13 130 | A1 | 10/1995 |
| DE | 198 05 394 | C2 | 8/1999 |
| DE | 199 21 554 | A1 | 11/1999 |
| DE | 100 23 054 | A1 | 9/2001 |
| EP | 1 026 932 | | 8/2000 |
| FR | 2 770 897 | | 5/1999 |
| GB | 1 537 821 | | 1/1979 |

* cited by examiner

*Primary Examiner*—Melvin Jones
(74) *Attorney, Agent, or Firm*—Pauley Petersen & Erickson

(57) ABSTRACT

A recirculation cooling system including a refrigeration circuit, a water circuit, a tank and a pump, the evaporator of the refrigeration circuit being allocated to the water circuit in order to exchange heat. All components are contained in a housing. This invention provides a recirculation cooling system that can be positioned in a space-saving manner and is readily accessible for maintenance. The rear wall of the housing is positioned against and fixed to a vertical side panel of, for example, a switchgear cabinet, a machine housing or a wall. The interior of the housing is sub-divided into two sub-chambers by a partition, one sub-chamber being situated between the side panel and the partition and the second sub-chamber being situated between the partition and the front face of the housing. The condenser and the ventilator are located in the sub-chamber allocated to the front face of the housing and the tank and pump are located in the rear sub-chamber. The respective sub-chambers can be accessed from the respective allocated face of the housing.

9 Claims, 2 Drawing Sheets

RECIRCULATION COOLING SYSTEM

BACKGROUND OF THE INVENTION

1. Field of the Invention

This invention relates to a recirculation cooling system with a refrigeration circuit and a water circuit, which have an evaporator, a liquefier, a compressor, a pump, a tank and a fan as components, and are housed in two partial areas of a receiver housing, wherein the receiver housing can be connected with one side of a switchgear cabinet or machine housing, and the partial area with the refrigeration circuit is in heat-conducting contact with the interior of the switchgear cabinet or machine housing.

2. Discussion of Related Art

A recirculation cooling system for a switchgear cabinet of this type is known from German Patent Reference DE 44 13 130 A. All components of this known recirculation cooling system are housed in a receiver housing, which is divided into a lower and an upper partial area by a horizontal separating wall. Here, the lower partial area of the receiver housing is placed on the switchgear cabinet, wherein the components housed in this partial area, in particular the heat exchanger, are in heat-conducting contact with the interior of the switchgear cabinet.

This connection between a switchgear cabinet and a recirculation cooling system makes access to the components of the recirculation cooling system and their maintenance considerably more difficult.

As German Patent Reference DE 199 21 554 A1 shows, a cooling device is also already known which is divided into two partial areas by a vertical separation wall. The partial areas are occupied by the components of the cooling device and are in air-conducting contact with the interior of the switchgear cabinet and with the surroundings of the switchgear cabinet. No details of the housing structure are disclosed by the publication. In this cooling device the compressor occupies a space which extends over both partial areas of the cooling device.

In connection with a cooling device with a compressor it is known to place it into a housing in such a way that it is accessible from the front, as shown in U.S. Pat. No. 5,839,295.

SUMMARY OF THE INVENTION

It is one object of this invention to provide a recirculation cooling system for a switchgear cabinet of the type mentioned at the outset, which can be installed with a low structural depth on a vertical side of the switchgear cabinet, wherein all components are easily accessible for maintenance.

In accordance with this invention, this object is accomplished with a receiver housing attached with an open back to a vertical side of the switchgear cabinet or machine housing. The interior of the receiver housing is divided into a front and a rear partial area by a separating wall, wherein the open back is connected with the switchgear cabinet of the machine housing and the rear partial area receives the evaporator, the pump and the tank. The front partial area receives the liquefier and the fan and is connected with the surroundings via openings in the front wall, wherein the openings have covers and/or guide elements which are assigned to the fan and the liquefier and guide the supplied airflow into different directions, and the compressor of the refrigeration circuit is housed in a reception area which bridges both partial areas and is accessible through the front of the receiver housing.

With this layout, of the receiver housing, the entire installation side of the switchgear cabinet is used for heat-conducting contact between the interior of the switchgear cabinet and the facing partial rear areas of the recirculation cooling system is utilized. Also, because of the division of the components the horizontal structural depth, i.e. the additionally required space, remains low. A further advantage is that the components in the rear partial areas are accessible for maintenance through the open rear of the recirculation cooling system.

In one embodiment of this invention, a return line of the water circuit is assigned to the evaporator and, adjoining the evaporator, terminates in the tank. A feed line branching off the pump runs out of the tank. The feed and the return lines are both conducted to the roof area of the receiver housing and project therefrom at least by connectors for water circuit lines. By conducting the lines in this way it is possible to perform the replenishing of the water circuit from the side of the cover of the recirculation cooling system.

Because the feed and return lines with the connectors are fastened on the cover of the receiver housing, a connection with each system to be cooled can be easily provided. The connectors are housed stably and in a protected manner.

The ease of servicing of the recirculation cooling system can also be increased if an electronic control device is housed in a lateral receiving area of the receiver housing and is accessible via a separate service cover in the area of the lateral wall of the receiver housing.

In order to maintain a low structural depth, the fan can be a radial fan and for the pump to be an immersion pump, which is inserted into a tank which is tall with respect to its structural depth.

In one embodiment of this invention, the partial area at the front is connected with the surroundings via at least one opening. The openings are arranged in the front wall of the receiver housing, wherein the fan and the liquefier are connected with the surroundings through the openings. The openings are formed by covers, or are overlapped by covers, which conduct the airflow provided to the liquefier and the fan in different directions by guide elements. With this arrangement the air guidance of the outer circuit is connected with the surroundings only via the front side of the housing. Thus the recirculation cooling system can also be installed in a space-saving manner directly at the side of adjoining housings or the like.

In order to maintain a low structural depth, the fan can be a radial fan and the pump can be an immersion pump, which is inserted into a tank which is tall with respect to its structural depth.

In a further embodiment of this invention, the compressor of the refrigeration circuit is arranged in a receiving area which bridges the two partial spaces and is accessible via the front of the receiving housing. If service is required, the compressor is accessible via the front of the device.

BRIEF DESCRIPTION OF THE DRAWINGS

This invention is explained in view of an exemplary embodiment represented in the drawings, wherein.

DESCRIPTION OF PREFERRED EMBODIMENTS

Figure 1:
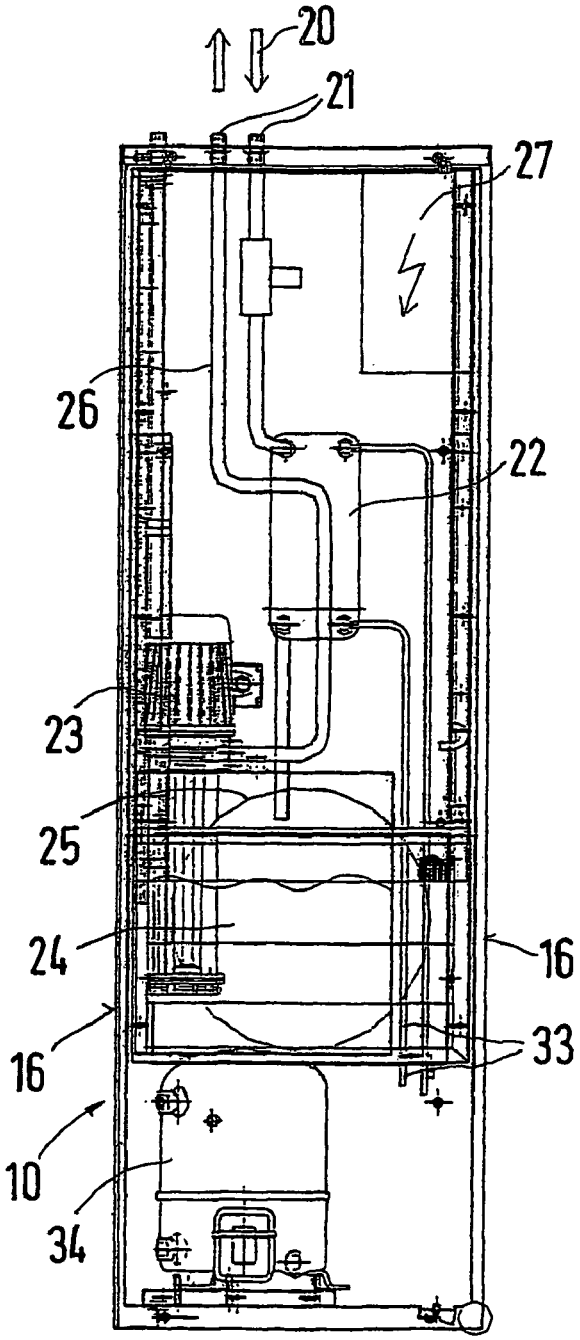
FIG. 1 is a rear view of a recirculation cooling system.
Figure 2:
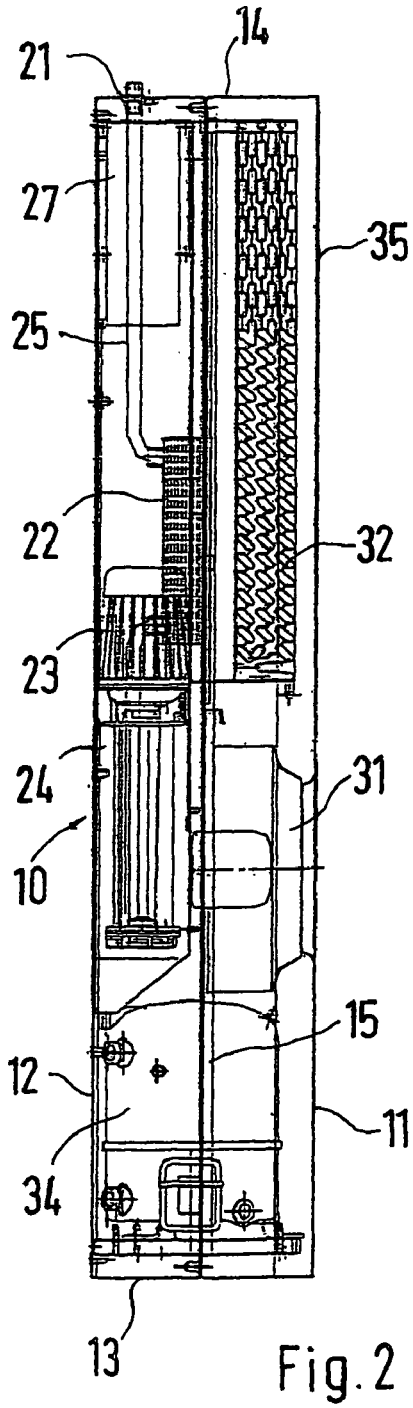
FIG. 2 shows the recirculation cooling system of FIG. 1 but in a plan view from the right side.

A recirculation cooling system is represented in FIGS. 1 and 2, and has a receiver housing 10 with a rear wall 12 and a front wall 11 arranged parallel with respect to the rear wall 12. A floor 13, a cover 14 and lateral walls 16 extend between the rear wall 12 and the front wall 11.

A separating wall 15 is arranged parallel with respect to the rear wall 12 and the front wall 11 and separates the receiving space surrounded by the receiver housing 10 into two partial spaces.

A liquefier 32 and a fan 31 of a refrigeration circuit are housed in the partial space assigned to the front of the device. The fan 31 is embodied as a radial fan and aspirates air from the surroundings via the open front wall 11 along its axis of rotation and blows it out radially. The air is then conducted through the liquefier 32 and is released, warmed again, through the open front wall 11 to the surroundings.

An evaporator 22 of the refrigeration circuit is arranged in the second partial space of the receiver housing 10. A compressor 34 of the refrigeration circuit is arranged in the area of the floor 13 of the receiving housing 10 and is arranged in a connecting area bridging the two partial spaces. In this case, the compressor 34 is arranged so that its connecting side and electrical shielding are accessible through the front wall 11. The individual components of the refrigeration circuit are connected with each other by coolant lines 33. Components of a water circuit 20 are housed in the rear partial space. For service purposes, the rear wall 12 is designed to be open. The rear partial space receives a tank 24, into which a pump 23 is inserted. The pump 23 is designed as an immersion pump. The tank 24 is connected with the evaporator 22 via a return line 25. The return line 25 is conducted through the evaporator 22. Following the evaporator 22, the return line 25 leads to the cover 14 and is fastened there to the connector 21.

The feed line 26 is also maintained on the cover 14 by a connector 21 and leads to the pump 23.

Figure 3:
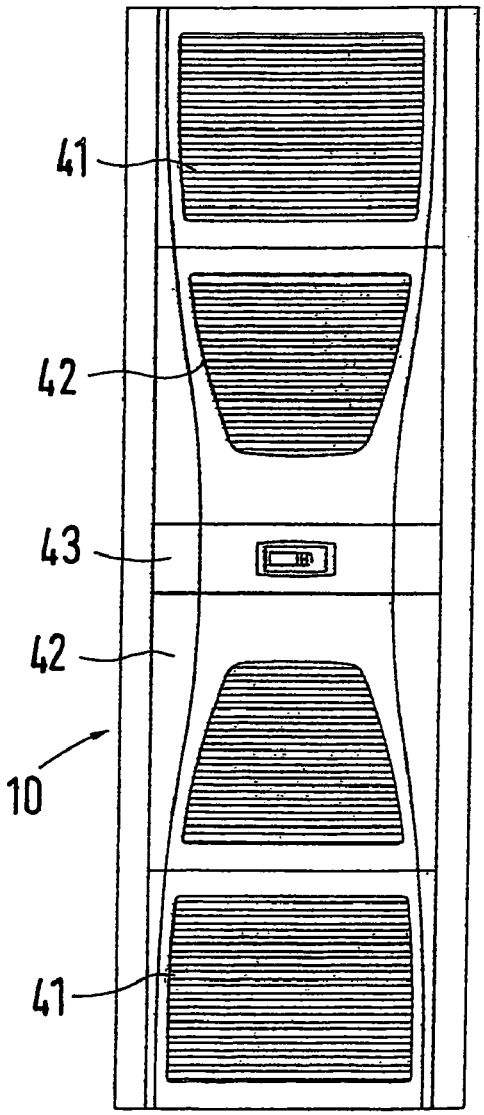
FIG. 3 shows the recirculation cooling system of FIGS. 1 and 2 in a front view and with covers applied.
Figure 4:
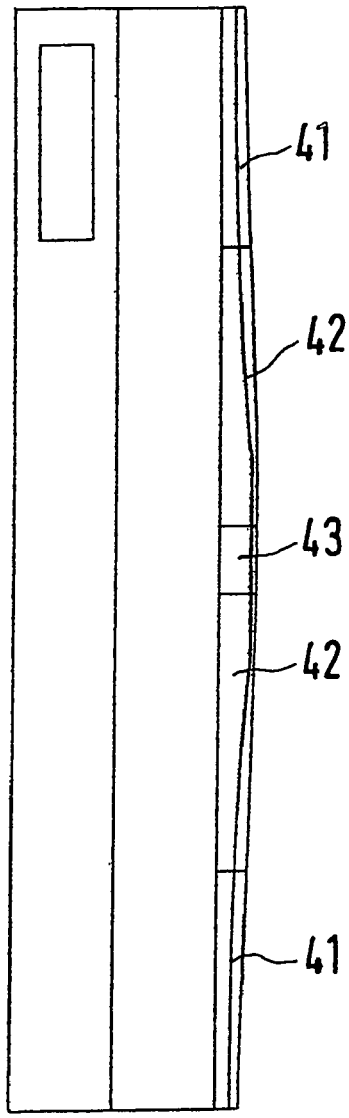
FIG. 4 shows the representation in accordance with FIG. 3 but in a plan view from the left side.

As FIGS. 3 and 4 show, the open front wall 11 is closed off by covers 41, 42. In this case, two upper and two lower covers 41, 42 are used. The two covers 41, as well as 42, are identical, but are installed rotated by 180° and constitute openings, which are covered by plate gratings formed on them. The plate gratings have inclined plates which, as guide elements, guide the airflow in the direction toward the cover or bottom 14, 13. In this way, a short circuit of the air, which would hamper air from entering or leaving, is avoided. The covers 41, 42, and a central cover 43, can be removed. The front wall 11 is then accessible, and service work can be performed through its openings in the front partial space.

The recirculation cooling system is installed with its rear wall 12 on a vertical wall. To perform service work on the components of the water circuit 22, it is only necessary to remove the receiver housing 10 from the vertical wall. Then the open rear wall 12 permits access to the rear partial space.

The invention claimed is:

1. A recirculation cooling system with a refrigeration circuit and a water circuit, having an evaporator, a liquefier, a compressor, a pump, a tank and a fan as components housed in two partial areas of a receiver housing, wherein the receiver housing can be connected with one side of one of a switchgear cabinet and a machine housing and the partial area with the refrigeration circuit in heat-conducting contact with an interior of the one of the switchgear cabinet and the machine housing, the recirculation system comprising:

the receiver housing (10) attached with an open back to a vertical side of the one of the switchgear cabinet and the machine housing, the interior of the receiver housing (10) divided into a front and a rear partial area by a separating wall (15), the open back connected with the switchgear cabinet of the machine housing and the rear partial area receiving the evaporator (22), the pump (23) and the tank (24), the front partial area receiving the liquefier (32) and the fan (31) and connected with the surroundings via openings in the front wall (11), wherein the openings have at least one of covers and guide elements assigned to the fan (31) and the liquefier (32) and guiding supplied airflow into different directions, and the compressor (34) of the refrigeration circuit housed in a reception area which bridges both partial areas and is accessible through the front of the receiver housing (10).

2. The recirculation cooling system in accordance with claim 1, wherein a return line (25) of the water circuit (20) is connected with the evaporator (22) which adjoining the evaporator (22) terminates in the tank (24), a feed line (26) branching off the pump (23) runs out of the tank (24), and the feed line (26) and the return line (27) are both conducted to a roof area of the receiver housing (10) and project therefrom at least by connectors (21) for water circuit lines.

3. The recirculation cooling system in accordance with claim 2, wherein the feed line (26) and the return line (27) are fastened with the connectors (21) on the cover (14) of the receiver housing (10).

4. The recirculation cooling system in accordance with claim 3, wherein an electronic control device (27) is housed in a lateral receiving area of the receiver housing (10) and is accessible via a separate service cover near the lateral wall (16) of the receiver housing (10).

5. The recirculation cooling system in accordance with claim 4, wherein the fan (31) is a radial fan.

6. The recirculation cooling system in accordance with claim 5, wherein the pump (23) is an immersion pump which is inserted into a tank (24) which is tall with respect to a structural depth of the tank (24).

7. The recirculation cooling system in accordance with claim 1, wherein an electronic control device (27) is housed in a lateral receiving area of the receiver housing (10) and is accessible via a separate service cover near the lateral wall (16) of the receiver housing (10).

8. The recirculation cooling system in accordance with claim 1, wherein the fan (31) is a radial fan.

9. The recirculation cooling system in accordance with claim 1, wherein the pump (23) is an immersion pump which is inserted into a tank (24) which is tall with respect to a structural depth of the tank (24).

* * * * *